US006248496B1

(12) United States Patent
Galloway et al.

(10) Patent No.: US 6,248,496 B1
(45) Date of Patent: Jun. 19, 2001

(54) METHOD OF REPLENISHING DEVELOPER IN A HYBRID SCAVENGELESS DEVELOPMENT SYSTEM

(75) Inventors: Merrilee A. Galloway, Macedon; Scott M. Silence, Fairport; William H. Hollenbaugh, Jr.; Amy L. Stamp, both of Rochester; Padam K. Angra, Penfield, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/520,361

(22) Filed: Mar. 7, 2000

(51) Int. Cl.[7] ..... G03G 9/00
(52) U.S. Cl. ..... 430/137; 399/30; 399/62
(58) Field of Search ..... 399/30, 62; 430/137

(56) References Cited

U.S. PATENT DOCUMENTS

| | | | | |
|---|---|---|---|---|
| 3,707,134 | * | 12/1972 | Gawrow | 399/62 |
| 3,821,938 | * | 7/1974 | Bacon et al. | 399/30 |
| 3,847,604 | | 11/1974 | Hagenbach et al. . | |
| 4,298,672 | | 11/1981 | Lu . | |
| 4,338,390 | | 7/1982 | Lu . | |
| 4,558,108 | | 12/1985 | Alexandru et al. . | |
| 4,614,165 | | 9/1986 | Folkins et al. . | |
| 4,935,326 | | 6/1990 | Creatura et al. . | |
| 4,937,166 | | 6/1990 | Creatura et al. . | |
| 5,227,460 | | 7/1993 | Mahabadi et al. . | |
| 5,545,501 | | 8/1996 | Tavernier et al. . | |
| 5,557,393 | | 9/1996 | Goodman et al. . | |
| 5,978,633 | | 11/1999 | Hirsch et al. . | |

OTHER PUBLICATIONS

Steven C. Hart et al., "Trickle–Continuous Developer Material Replenishment for Two Component Development Systems", The Sixth International Congress on Advances in Non–Impact Printing Technologies, pp. 44–54.

* cited by examiner

*Primary Examiner*—John Goodrow
(74) *Attorney, Agent, or Firm*—Oliff & Berridge, PLC; Eugene O. Palazzo

(57) ABSTRACT

A replenisher material of toner particles and carrier particles, wherein a replenisher ratio of the toner particles to the carrier particles in the replenisher is determined as a function of at least one property of the developer and at least one operational property of an apparatus for developing an electrostatic latent image recorded on an image receiving member, and wherein the apparatus includes a housing defining a chamber having a supply of developer comprised of toner particles and carrier particles therein, a donor member spaced from the image receiving member and adapted to transport toner particles of the developer from the chamber to a development zone adjacent the image receiving member, at least one wire positioned in the development zone between the image receiving member and the donor member, a voltage supply for electrically biasing the at least one wire during a developing operation with a current to detach toner particles from the donor member, forming a cloud of toner particles in the development zone, and developing the latent image with toner particles from the cloud, and at least one dispenser for dispensing replenisher comprised of toner particles and carrier particles into the chamber, wherein a replenisher ratio of the toner particles to the carrier particles in the replenisher is determined as a function of at least one property of the developer and at least one operational property of the apparatus. The replenisher ratio is preferably determined as a function of the tribo stability of the developer in a non-replenishment mode of the apparatus and/or as a function of the conductivity of the developer in a non-replenishment mode of the apparatus.

24 Claims, 2 Drawing Sheets

METHOD OF REPLENISHING DEVELOPER IN A HYBRID SCAVENGELESS DEVELOPMENT SYSTEM

BACKGROUND OF THE INVENTION

1. Field of Invention

This invention relates to a replenisher and a method of replenishing a xerographic device, particularly a xerographic device utilizing a hybrid scavengeless development system. More in particular, the invention relates to a method of determining optimal replenisher ratio to a xerographic device.

2. Description of Related Art

Historically, xerography has not been required to deliver prints of the same caliber as offset lithography. The offset lithography customer demands a level of print quality much higher than is available from conventional xerographic machines.

U.S. Pat. No. 5,545,501 describes an electrostatographic developer composition comprising carrier particles and toner particles with a toner particle size distribution having a volume average particle size (T) such that 4 $\mu$m$\leqq$T$\leqq$12 $\mu$m and an average charge (absolute value) pro diameter in femtocoulomb/10 $\mu$m ($C_T$) after triboelectric contact with said carrier particles such that 1 fC/10 $\mu$m$\leqq C_T \leqq$10 fC/10 $\mu$m characterized in that (i) said carrier particles have a saturation magnetization value, $M_{sat}$, expressed in Tesla (T) such that $M_{sat} \geqq 0.30$ T, (ii) said carrier particles have a volume average particle size ($C_{avg}$) such that 30 $\mu$m$\leqq C_{avg} \leqq$60 $\mu$m, (iii) said volume based particle size distribution of said carrier particles has at least 90% of the particles having a particle diameter C such that 0.5 $C_{avg} \leqq C \leqq 2\ C_{avg}$, (iv) said volume based particles size distribution of said carrier particles comprises less than b % particles smaller than 25 $\mu$m wherein $b=0.35\times(M_{sat})^2\times P$ with $M_{sat}$: saturation magnetization value, $M_{sat}$, expressed in T and P: the maximal field strength of the magnetic developing pole expressed in kA/m, and (v) said carrier particles comprise a core particle coated with a resin coating in an amount (RC) such that 0.2% w/w$\leqq$RC$\leqq$2% w/w. See the Abstract. This patent describes that such developer achieves images of offset-quality in systems in which a latent image is developed with a fine hair magnetic brush. See column 4, lines 7–17.

It is known in the art to add additional toner and/or carrier materials to the housing of a xerographic device in order to replenish these materials depleted by the copying (image formation) process of the device. See, for example, U.S. Pat. No. 4,614,165, incorporated herein by reference in its entirety.

What is desired is a replenisher and an optimization of replenisher ratio (the ratio of toner to carrier in the replenisher) for each color developer to be used in forming a xerographic image with a xerographic device, particularly a device utilizing a hybrid scavengeless development scheme. Optimization of the replenisher ratio can enable the device to constantly and consistently produce images, particularly color images, exhibiting a quality analogous to that achieved in offset lithography.

SUMMARY OF THE INVENTION

It is an object of the present invention to provide a replenisher having a toner to carrier replenisher ratio that is optimized with respect to the properties of the toner and developer as well as the properties of the device in which the replenisher will be added.

It is a further object of the present invention to provide a method for optimizing the replenisher ratio of a replenisher in order to continuously achieve high, offset lithography quality images from a device to which the replenisher is added.

It is a still further object of the present invention to provide a device for forming images of offset lithography quality utilizing a hybrid scavengeless development system in which the developer for each color used in forming images with the device is replenished with developer having a preferred replenisher ratio.

DETAILED DESCRIPTION OF PREFERRED EMBODIMENTS

Figure 1:
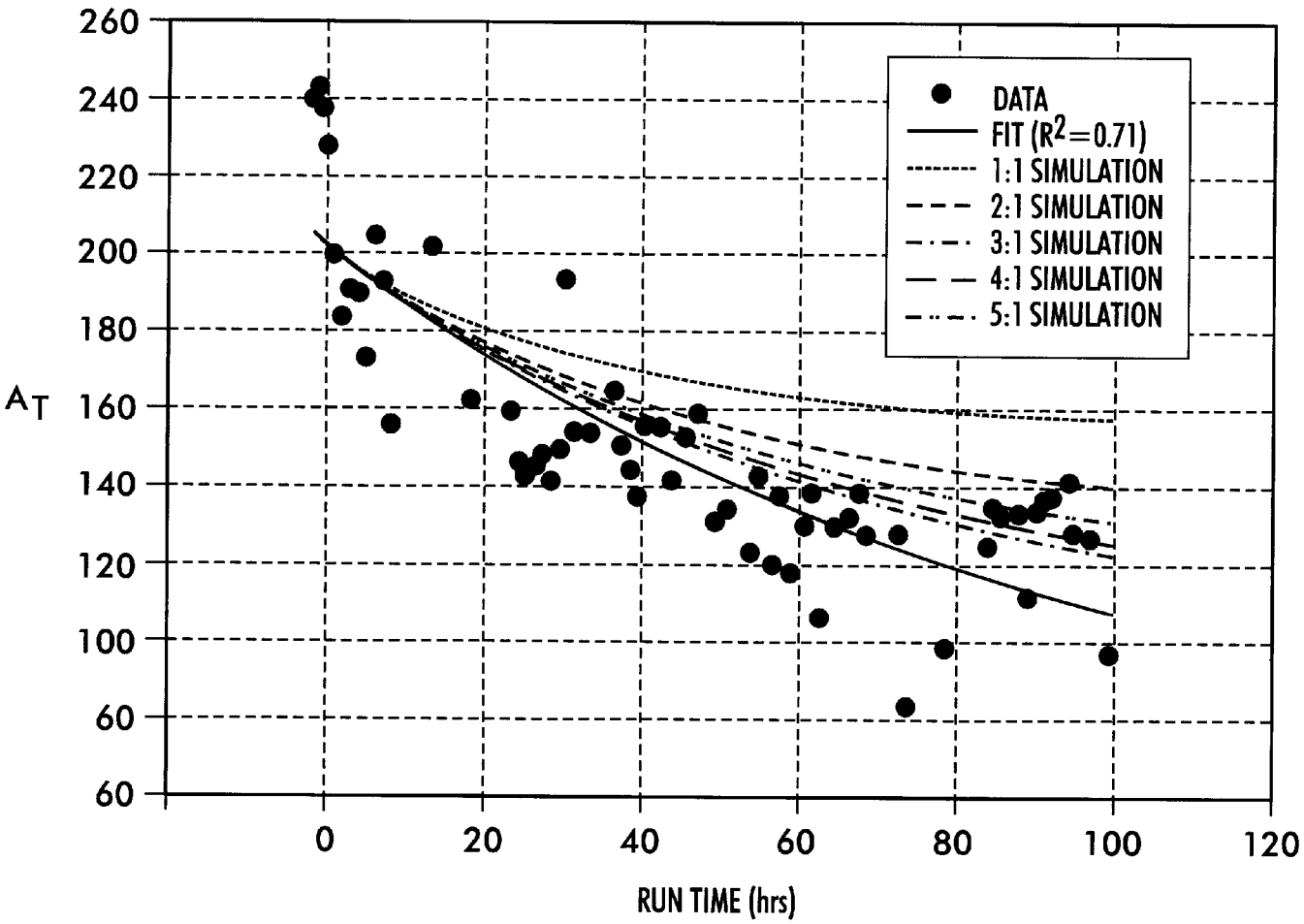
FIG. 1 illustrates a plot modeling a sample developer for determination of a proper replenisher ratio in a particular device based upon $A_T$.

Generally, the process of electrophotographic printing includes charging a photoconductive member to a substantially uniform potential to sensitize the surface thereof. The charged portion of the photoconductive surface is exposed to a light image from, for example, a scanning laser beam, an LED source, etc., or an original document being reproduced. This records an electrostatic latent image on the photoconductive surface of the photoreceptor. After the electrostatic latent image is recorded on the photoconductive surface, the latent image is developed.

In the present invention, two-component developer materials are used in the first step of the development process. A typical two-component developer comprises magnetic carrier granules having toner particles adhering triboelectrically thereto. Toner particles are attracted to the latent image, forming a toner powder image on the photoconductive surface. The toner powder image is subsequently transferred to a copy sheet. Finally, the toner powder image is heated to permanently fuse it to the copy sheet in image configuration.

The electrophotographic marking process given above can be modified to produce color images. One type of color electrophotographic marking process, called image-on-image (IOI) processing, superimposes toner powder images of different color toners onto the photoreceptor prior to the transfer of the composite toner powder image onto the substrate. While the IOI process provides certain benefits, such as a compact architecture, there are several challenges to its successful implementation. For instance, the viability of printing system concepts such as IOI processing requires development systems that do not interact with a previously toned image. Since several known development systems, such as conventional magnetic brush development and jumping single-component development, interact with the image on the receiver, a previously toned image will be scavenged by subsequent development if interacting development systems are used. Thus, for the IOI process, there is a need for scavengeless or noninteractive development systems.

Hybrid scavengeless development (HSD) technology develops toner via a conventional magnetic brush onto the surface of a donor roll. A plurality of electrode wires is closely spaced from the toned donor roll in the development zone. An AC voltage is applied to the wires to generate a toner cloud in the development zone. This donor roll generally consists of a conductive core covered with a thin, for example 50–200 μm, partially conductive layer. The magnetic brush roll is held at an electrical potential difference relative to the donor core to produce the field necessary for toner development. The toner layer on the donor roll is then disturbed by electric fields from a wire or set of wires to produce and sustain an agitated cloud of toner particles. Typical AC voltages of the wires relative to the donor are 700–900 Vpp at frequencies of 5–15 kHz. These AC signals are often square waves, rather than pure sinusoidal waves. Toner from the cloud is then developed onto the nearby photoreceptor by fields created by a latent image.

In the present invention, while any suitable electrostatic image development device may be used, it is most preferred to use a device employing the hybrid scavengeless development system. Such a system is described in, for example, U.S. Pat. No. 5,978,633, the entire disclosure of which is incorporated herein by reference.

The basic components of a hybrid scavengeless development system have been described in the art such as discussed above, and thus are not extensively discussed in the present application. It is sufficient to note that an HSD development apparatus includes a housing containing developer for developing latent images formed on a photoreceptor surface. The housing contains a development system. A development system advances developer materials into development zones. The development system is scavengeless. By scavengeless is meant that the developer or toner of the system must not interact with an image already formed on the image receiver. Thus, the system is also known as a non-interactive development system. The development system comprises a donor structure in the form of a donor roll. The donor roll conveys a toner layer to the development zone which is the area between the photoreceptor and the donor roll. A toner layer is preferably formed on the donor roll by a two-component developer (i.e., a developer containing both toner and carrier). The development zone contains an AC biased electrode structure self-spaced from the donor roll by the toner layer. For donor roll loading with two-component developer, a conventional magnetic brush is preferably used for depositing the toner layer onto the donor roll. The magnetic brush may include a magnetic core enclosed by a sleeve. An auger is also preferably included within the housing, mounted rotatably to mix and transport developer material. The augers preferably have blades extending spirally outwardly from a shaft, designed to advance the developer material in the axial direction substantially parallel to the longitudinal axis of the shaft.

As successive electrostatic latent images are developed, the toner particles within the developer material are depleted. A dispenser stores a supply of fresh developer. The dispenser is in communication with the housing. As the concentration of toner particles in the developer material is decreased, fresh developer is furnished to the developer material in the chamber from the toner dispenser. The augers in the chamber of the housing mix the fresh toner particles with the remaining developer material so that the resultant developer material therein is substantially uniform with the concentration of toner particles being optimized. In this manner, a substantially constant amount of toner particles are maintained in the chamber of the developer housing.

In embodiments of the present invention, an electrostatographic imaging device is provided, wherein the device comprises two or more separate developer housings. In embodiments containing two or more developer housings, the multiple developer housings may be contained in a single electrostatographic module wherein the photoreceptor or imaging member makes a single pass through the system or makes multiple passes through the system. The multiple developer housings may also be incorporated into the device in the form of multiple complete electrostatographic modules, each comprising a separate charging, exposure, development, transfer and cleaning step.

In preferred embodiments of the present invention utilizing a hybrid scavengeless development system, blends of two or more base color toners may be utilized in a single developer housing to achieve a broad range of specific customer selectable colors. If a print engine with only one such developer housing is used, the result is single-color prints or copies in the specific customer selectable color. However, as is known in the art, multiple developer housings may be co-resident in the print engine, thus resulting in a color printer producing one-color prints (if all developer housings contain the same color toner composition) or multi-color prints (if developer housings contain different color compositions). For example, in an embodiment comprising two co-resident developer housings, one developer housing may contain a color toner composition, and the other developer housing may contain a black toner composition. The result is a highlight two-color printer with a customer selectable highlight color. In another embodiment of the present invention, four or more developer housings may be used for process color printing, for example, with cyan, magenta, yellow and black toner compositions, and an additional developer housing or housings is provided with a blend of the base color toners for customer selectable specialty, highlight or spot color(s).

Most preferably, the imaging device will contain at least four developer housings, one for each of the developer colors cyan, magenta, yellow and black, which can form vivid full color images as well known in the art.

In embodiments of the present invention, the normal mode of operating the development machine would be to have the same color developer in both the developer housing and the dispenser. However, in embodiments of the present invention, it is possible to start a print run with one color or blend in the developer housing and another color or blend in the dispenser. In this manner, the end-user may have the option of creating multiple highlight colors in a single print run. For example, if a different color toner composition blend is introduced in the dispenser, the hue of the final toner composition would change continuously over a print run of several hundred prints, the number of prints depending on area coverage, developability, and other factors.

A supply of developer material is initially charged to and stored in a chamber of the housing. As the electrophotographic printing device is used, toner particles in the developer are depleted therefrom and must be replenished through the dispensers, for example cartridges containing additional toner and carrier materials.

In addition, it has been found that the carrier granules age and the entire developer material, i.e., both carrier granules and toner particles should be periodically replaced in order to obtain the requisite copy quality as is discussed more fully below, and also in U.S. Pat. No. 4,614,165, incorporated herein by reference in its entirety.

In order to provide fresh toner into the housing and also to address the aging of the toner and carrier of the developer within the housing, so-called trickle-through is used. Again see U.S. Pat. No. 4,614,165, as well as U.S. Pat. No. 5,557,393 which is also incorporated herein by reference in its entirety. In a trickle-through system, the dispenser dispenses a combination of toner and carrier particles known as a replenisher. Replenisher typically contains greater amounts of toner to carrier than in the initially charged developer. While additional replenisher is being added to the developer housing, a small amount of developer is continuously being removed from the developer housing by means of a drop tube or other mechanism, the rate of addition being approximately equal to the rate of toner usage and developer removal. Such a trickle-through system is disclosed in both U.S. Pat. Nos. 4,614,165 and 5,557,393, discussed above.

There is a distinction between replenisher and developer. Developer is blended in a device external to a machine prior to its introduction to the machine, ensuring a high degree of homogeneity in the toner concentration and a degree of tribo charging of the toner. Replenisher is carrier and toner put separately into a bottle and dispensed in a very inhomogeneous manner into a machine, which then homogenizes the toner and carrier and does the charging.

Satisfaction of stringent offset-like print quality requirements in a xerographic engine has been enabled in the present invention by IOI xerography of which hybrid scavengeless development is a preferred subsystem component. Both the image quality and the unique subsystem requirements result in highly constrained toner and developer designs, and thus in turn in highly constrained replenisher requirements in order to maintain the toner and developer properties throughout operation of the device. This invention describes the aspects of novel toners, developers and particularly replenishers that operate in this restrictive atmosphere to produce prints of near offset quality.

In addition to achieving offset-like print quality, the digital imaging processes of the above-described device also enables customization of each print (such as an address, or special information for regional distribution), which is not practical with offset lithography.

This invention describes a replenisher to enable a toner and developer to ideally function in the restrictive atmosphere of the device discussed above. Using such replenisher enables the device to deliver prints that will delight the customer with vivid (high Chroma), reliable color rendition. Color gamut, the maximum set of colors that can be printed, is benchmark for a four-color xerographic system. Solid and halftone areas are uniform and stable in density and color. They are of uniform gloss. Pictorials contain accurate, realistic rendition. Text is crisp with well-defined edges regardless of font size or type. There is no background. Color, solids, halftones, gloss, pictorials, text and background are stable over the entire job run. The prints do not exhibit objectionable paper curl, nor are the images disturbed by handling or storage, for example when stored in contact with vinyl or other document surfaces.

To meet these print quality attributes, replenisher materials must operate in a consistent, predictable manner which result in a stable charge level and a stable conductivity level of the developer throughout operation of the imaging device. The most significant replenisher material parameter is the ratio of toner to carrier in the replenisher (i.e., the replenisher ratio) to provide the tribo and conductivity stability to the developer.

Below are listed the toner and developer material parameters and the print quality attributes that the parameters influence, particularly with respect to the replenisher materials.

A. Developer Charge

Developer charge level is correlated with development and transfer (including transfer efficiency and uniformity) performance. Print quality attributes that are affected by toner charge level include overall text quality (particularly the ability to render fine serifs), line growth/shrinkage, halo (a white region at the interface of two colors, also evident when text is embedded on a solid background), interactivity (toner of one color participating in the development process of another color, for instance by being scavenged from the printed area of a first color and being redeveloped into the printed area of a second color), background and highlight/shadow contrast (TRC). Failure modes identified with low developer charge include positive line shrinkage, negative line growth, halo, interactivity, background, poor text/serif quality, poor highlight contrast and machine dirt. Problems associated with high developer charge include low development, low transfer efficiency (high residual mass per unit area), poor shadow contrast and interactivity.

Additionally, the developer charge level must be maintained over a wide range of area coverage (AC) and job run length. Since the device of the invention is preferably a full color machine aimed at the offset market, AC and job run length will vary over a broad range. Print jobs such as annual reports will contain predominantly black text, with cyan, magenta and yellow used only for "spot color" applications such as logos, charts and graphs. For fill color pictorials, the job can range from very light pastels, with mostly cyan, magenta and yellow, and very little black, to dark rich colors with high usage of cyan, magenta and yellow. In some scenarios, black will be used as replacement for equal amounts of cyan, magenta and yellow to reduce the overall toner layer thickness. Each scenario has a unique combination of AC for each of the colors cyan, magenta, yellow and black. Developer charge level and distribution cannot vary based on the corresponding average residence time of a toner in the housing (i.e., high AC=low residence time with a lot of turnover of toner in the housing; conversely low AC=high residence time).

B. Toner Charge Distribution

It is desired that freshly added toner rapidly gains charge to the same level of the incumbent toner in the developer. If this is not the case, two distinct situations may occur. When freshly added toner fails to rapidly charge to the level of the toner already in the developer, a situation known as "slow admix" occurs. Distributions can be bimodal in nature, meaning that two distinct charge levels exist side-by-side in the development subsystem. In extreme cases, freshly added toner that has no net charge may be available for development onto the photoreceptor. Conversely, when freshly added toner charges to a level higher than that of toner already in the developer, a phenomenon known as "charge-thru" occurs. Also characterized by a bimodal distribution, in this case the low charge or opposite polarity toner is the incumbent toner (or toner that is present in the developer prior to the addition of fresh toner). The failure modes for both slow admix and charge-thru are the same as those for low charge toner state above, most notably background and dirt in the machine, wire history, interactivity, and poor text quality.

Therefore, it is desirable to design toner and developer materials to have an average toner charge level that avoids failure modes of both too high and too low toner charge. This will preserve development of solids, halftones, fine lines and text, as well as prevention of background and image contamination. The distribution of toner charge level must be sufficiently narrow such that the tails of the distribution do not adversely affect image quality (i.e., the low charge population is not of sufficient magnitude so as to degrade the image quality attributes known to be related to low toner charge level). Toner charge level and distribution must be maintained over the full range of customer run modes (job run length and AC).

Thus, it is desirable to establish a replenisher ratio which will provide charge stability. This will enable an average charge level that avoids failure modes of both too high and too low charge. This will preserve development of solids, halftones, fine lines and text, as well as prevention of background and image contamination. The selection of the replenisher ratio must be such that the developer and toner charge level and distribution are maintained over the full range of customer run modes (job run length and AC).

C. Developer Conductivity

A hybrid scavengeless development system uses a magnetic brush of a conventional two component system in conjunction with a donor roll used in typical single component systems to transfer toner from the magnetic brush to the photoreceptor surface. As a result, the donor roll must be completely reloaded with toner in just one revolution. The inability to complete reloading of the donor roll in one revolution will result in a print quality defect called reload. . This defect is seen on prints as solid areas that become lighter with successive revolutions of the donor roll, or alternately if the structure of an image from one revolution of the donor roll is visible in the image printed by the donor roll on its next revolution, a phenomenon known as ghosting in the art related to single component xerographic development. Highly conductive developers aid in the reduction of this defect. The more conductive developers allow for the maximum transfer of toner from the magnetic brush to the donor roll.

It is the case that the developer becomes more insulative over time due to impaction of toner onto the carrier coating and transfer of toner external additives to the carrier. It is therefore necessary to replenish the developer with fresh materials which will dampen, preferably eliminate, this decay in the developer conductivity. A system which has trickle as discussed above allows for the maintenance of developer conductivity levels.

It is desirable to select a replenisher ratio which will dampen, preferably eliminate, the decay of developer conductivity over time. The replenisher ratio will then allow the developer materials to remain conductive enough to reload the donor roll in a single revolution.

In operation, toner will be used in developing latent images upon the surface of the imaging member (e.g., photoreceptor), and will need to be replenished in the developer chamber of the housing. Thus, during operation in replenishment mode, additional toner is added into the developer chamber in the housing from dispensers containing replenisher in order to maintain toner within the housing. The replenisher is comprised of both toner particles and carrier particles. The replenisher ratio (toner:carrier) in the replenisher is very significant since the replenishment rate (i.e., the rate at which the replenisher is added into the housing) will necessarily add the amount of carrier set by the ratio along with the amount of toner being added. Thus, the replenisher ratio must be appropriately determined so that the amount of carrier added at the replenishment rate is appropriate to maintain continued proper operation of the imaging device.

As discussed above, the proper selection of a replenisher ratio is required to maintain a stable developer charge level. By this invention, it has been determined that the replenisher ratio should most preferably be determined in terms of the tribo stability of the developer in a non-replenishment (i.e., non-trickle-through) mode of the device. In this way, the invention uniquely determines the replenisher ratio of the replenisher based upon the properties of the developer (toner and carrier) as well as upon the operational property requirements of the imaging device.

In a first aspect of this embodiment, the tribo stability of the developer can be specified in terms of the replenisher rate (R) required in order to meet a minimum $A_T$ value of the imaging device, which in turn is related to the replenisher ratio as noted above. $A_T$ is a convenient way to quantify the charging ability properties of a developer, while the minimum $A_T$ value of an imaging device is that $A_T$ of a developer below which imaging with the developer in the device fails (because, for example, the charge of the toner is so low that the electrostatic attractions needed for development fail). $A_T$ is defined as (tribo of developer)×(toner concentration of developer+offset value). For an imaging device utilizing an HSD system, the offset value is about 1.5 and the minimum $A_T$ is around 140 to 165, in units of $\mu$C/g times % toner, for example. These values can be derived by well known techniques in the art.

As discussed above, the developer charge decays over time in a non-trickle mode, and thus the $A_T$ also decays. The relationship between replenisher ratio and tribo stability is determined by first measuring the $A_T$ decay of developer in a non-trickle mode for a given replenisher ratio and then fitting the decay with a mathematical model. For example, the decay of $A_T$ is modeled as an exponential decay at various replenisher ratios as shown in FIG. 1. FIG. 1 is derived using a preferred cyan developer of the invention described more fully below. From the model, the following preferred relationship is determined $$R_c = MK_A((A_1/(A_0 - A_{min})) - 1)$$

where $R_c$=Replenisher rate (g/kp (i.e., grams/kiloprint) of carrier dispensed into the chamber)

M=Mass of material in the developer chamber (g)

$K_A$=Exponential decay constant in a non-trickle mode (1/kp)

$A_1$=Range of $A_T$ decay from t=0 to t=infinity $A_0$=Time=0 $A_T$ level $A_{min}$=Minimum $A_T$ level allowed in the system A kiloprint is 1,000 copies developed with the device. Recasting this in terms of a replenisher ratio:

$$R_c = 1/(RRY)$$

where $R_R$=Replenisher ratio (g of toner/g of carrier in replenisher)

Y=Toner yield (kp/g of toner)

Thus, $$(R_R Y)^{-1} = MK_A((A_1/(A_0 - A_{min})) - 1)$$

or $$R_R = (YMK_A((A_1/(A_0 - A_{min}) - 1))^{-1}$$

Once the decay is fit with the foregoing model, the constants of the equation are determined by any well known technique for analyzing the integrals of the exponential system. More generally, for any dependence of $A_T$ on developer age in a xerographic housing, the constants can be derived by, for example, applying trickle formalism, for example as explained in "Trickle-Continuous Developer Material Replenishment For Two Component Development Systems", Steven C. Hart et al., The Sixth International Congress on Advances In Non-Impact Printing Technologies, pages 44–54. The replenisher ratio can then be expressed in terms of the constants of the specific model as in the example shown explicitly above.

This method uniquely specifies the minimum replenisher ratio, that is, the least amount of carrier dispensed for a given amount of toner, as an implicit function of both the material (toner and carrier) properties and the xerographic development hardware properties. That is, from the above equation, the appropriate replenisher ratio for the replenisher can be calculated based upon the minimum $A_T$ requirement of the device, and deriving the appropriate constants, as determined from modeling of the aged developer. Since the replenisher ratio is an implicit function of the materials properties, the ratio can be optimized independently for each color or toner design in a fixed xerographic development housing.

In a second aspect of this embodiment, the replenisher ratio is derived not only based upon the tribo stability of the developer, but also upon the conductivity of the developer. The conductivity of the developer is primarily driven by the carrier conductivity. To achieve the most conductive carrier possible, partial coatings of polymers are employed to expose the carrier core as discussed more fully below. Additionally, irregularly shaped carrier cores provide valleys into which the polymer coating may flow, leaving exposed asperities for more conductive developers. The addition of zinc stearate to the toner additive package also assists in the lubrication of the carrier and toner, therefore increase the number of contacts between carrier and toner particles. Over time, however, the toner and external additive become impacted in the carrier coating, resulting in a decrease in developer conductivity. Therefore, it is desirable to select a replenisher ratio which will dampen, and preferably eliminate, the decay of developer conductivity over time. This replenisher ratio will then allow the developer materials to remain conductive enough to reload the donor roll in a single revolution.

Figure 2:
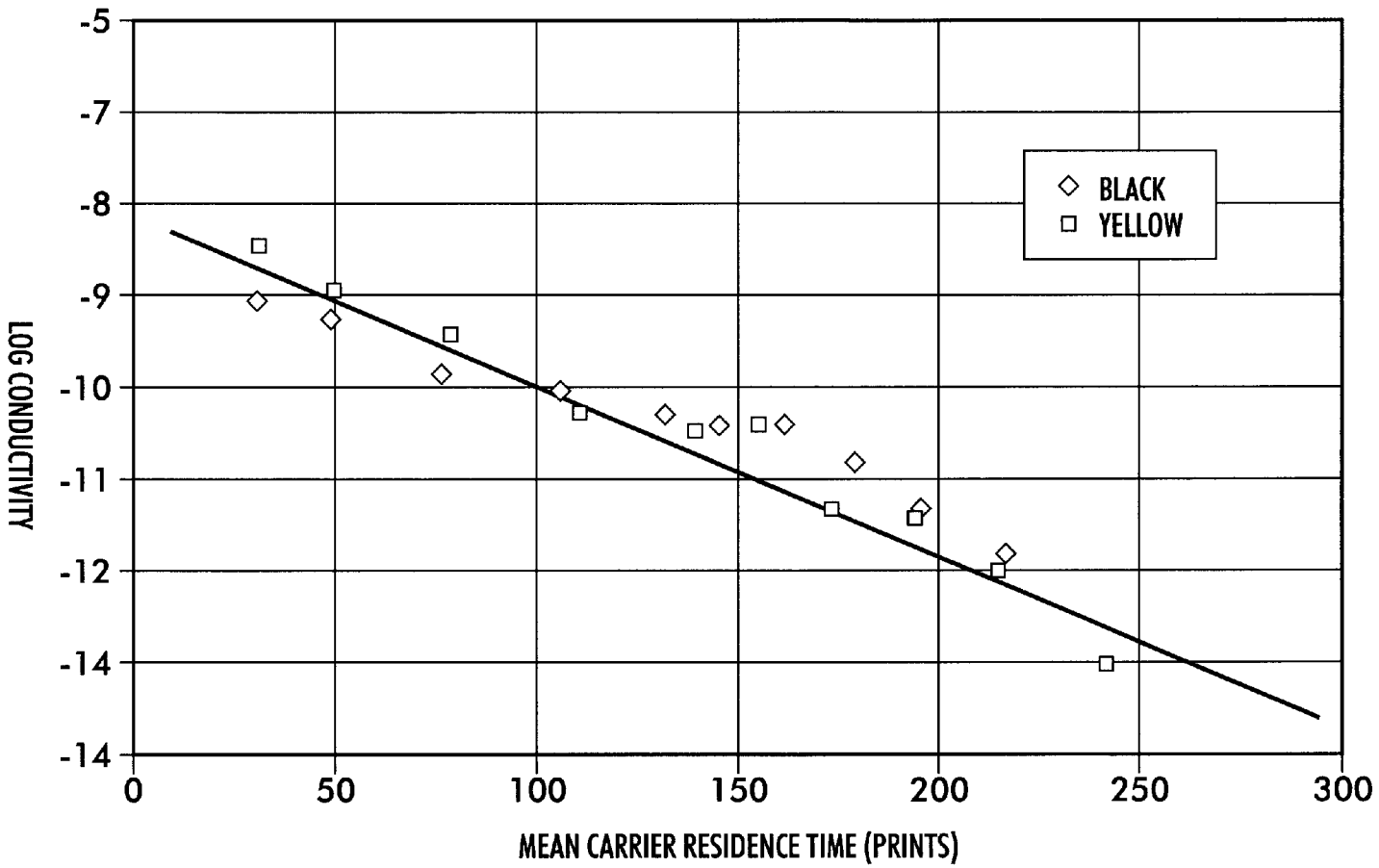
FIG. 2 illustrates a plot modeling a sample developer for determination of a proper replenisher ratio in a particular device based upon developer conductivity.

Thus, it is proposed that the replenisher ratio be specified also in terms of the conductivity stability in a non-replenishment (i.e., non-trickle) mode. A similar relationship as determined for the minimum $A_T$ level can be derived for the minimum conductivity level. Thus, the developer conductivity can, for instance, be modeled as an exponential relationship as shown in FIG. 2, the conductivity plotted over time (in kiloprints of the device). FIG. 2 is derived using a preferred black and yellow developer of the invention described more fully below. From the model, the following preferred relationship is determined along the same lines as above $$R_R=(YMK_\sigma((\sigma_0/(\sigma_0-\sigma_{min}))-1))^{-1}$$

where $R_R$, M and Y are as defined above $K_\sigma$=Exponential decay constant of $\sigma$ in a non-trickle mode (1/kp)

$\sigma_0$=Time=0 $\sigma$ level $\sigma_{min}$=Minimum $\sigma$ level allowed in the system Once the decay is fit with the foregoing model, the constants of this equation are determined by any of the well known techniques discussed above for analyzing the integrals of the exponential system.

In this embodiment, the replenisher ratio is determined to be the greater of the ratio determined as a function of the minimum $A_T$ level and the ratio determined as a function of the minimum conductivity level, that is the greater of the two amounts of carrier dispensed for a given amount of toner. Thus, for example, if the minimum $A_T$ level indicates a replenisher ratio of 3:1 and the minimum conductivity level indicates a replenisher ratio of 4:1, the ratio is set at 3:1 since that is the ratio required to avoid failure under both determinations.

In a most preferred embodiment in the present invention, the replenisher ratio (parts by weigh toner to parts by weight carrier) is between 2:1 and 8:1. Most preferably, the replenisher ratio is about 3:1.

The properties, features and materials of the preferred toner and carrier materials of the developer are described in detail in co-pending U.S. Application filed simultaneously herewith. The entire disclosure of this co-pending application is incorporated herein by reference in its entirety, and repeated below for the convenience of the Patent Office.

To meet these print quality attributes, toner materials must operate in a consistent, predictable manner. The most significant toner material parameters enabling the toners to so operate, particularly in the hybrid scavengeless development system atmosphere, are toner size distribution, toner melt flow and rheology, toner blocking temperature, resistance to offset against vinyl and other document surfaces, toner color, toner flow, and toner charge distribution.

Below are listed the toner material parameters and the print quality attributes that the parameters influence. Preferred values for the various properties are also described.

A. Toner Particle Size Distribution

Small toner size enables the reduction of TMA (transferred mass per unit area). This is especially important for Image-On-Image process color systems whereby color toners are layered. High mass of toner on paper causes objectionable document "feel" (unlike lithography), stresses fusing latitude, and increases paper curl. In addition, developability degradation can occur when a second or third toner layer is developed onto the first toner layer, due to development voltage nonuniformity. While it is desirable to have as small an average toner particle size as possible, there are failure modes identified with extremely small particles. Extremely fine toner particles are a stress to xerographic latitude as they exhibit increased toner adhesion to carrier beads, donor rolls and photoreceptors. Toner fines are also related to development instability, due to the lower efficiency of donor roll development of very small particles. Fine toner particles exhibit increased adhesion to the photoreceptor, impairing transfer efficiency and uniformity. The presence of coarse toner particles is related to HSD wire strobing and interactivity, and compromises the rendering of very fine lines and structured images.

Therefore, it is desirable to control the toner particle size and limit the amount of both fine and coarse toner particles. Small toner size is required for use in the present invention in order to enable high image quality and low paper curl. Narrow toner size distributions are also desired, with relatively few fine and coarse toner particles. In a preferred embodiment of the invention, the finished toner particles have an average particle size (volume median diameter) of from about 6.9 to 7.9 microns, most preferably of from about 7.1 to 7.7 microns, as measured by the well known Coulter counter technique. The fine side of the toner distribution is well controlled with only about 30% of the number distribution of toner particles (i.e., the total number of toner particles) having a size less than 5 microns, most preferably only about 15% of the number distribution of toner particles having a size less than 5 microns. The coarse side of the distribution is also very well controlled, with only about 0.7% of the volume distribution of toner particles having a size greater than 12.7 microns. This translates into a very narrow particle size distribution with a lower volume ratio geometric standard deviation (GSD) of approximately 1.23 and an upper volume GSD of approximately 1.21. The toners thus require small average particle size and a narrow particle size distribution.

B. Toner Melt Rheology

As process speed increases, dwell time through the fuser decreases, resulting in lower toner-paper interface temperatures. During the fusing event, it is necessary for toner particles to coalesce, flow and adhere to the substrate (for example, paper, transparency sheets, etc.) at temperatures that are consistent with the device process speeds. It is also necessary for the melt viscosity at the device fusing conditions to provide the required gloss level, while maintaining a high enough elasticity to prevent fuser roll hot-offset (i.e., transfer of toner to the fuser roll). Occurrence of offset results in print defects and a reduction of fuser roll life.

Therefore, it is desirable to choose an appropriate toner binder resin and control its melt rheology to provide low minimum fuse temperature, broad fusing latitude and desired gloss at the machine operating conditions. It is further desirable to use an appropriate binder resin such that the toner enables long fuser roll life.

The functionality required for the toners of the present invention is a controlled melt rheology which provides low minimum fuse temperature, broad fusing latitude and desired gloss at the machine operating conditions. The minimum fusing temperature is generally characterized by the minimum fix temperature (MFT) of the fusing subsystem (i.e., the lowest temperature of fusing that the toner will fix to substrate paper well, as determined by creasing a section of the paper with a toned image and quantifying the degree to which the toner in the crease separates from the paper). The fusing latitude is generally determined to be the difference between the hot offset temperature (HOT) (i.e., the highest temperature of fusing that can be conducted without causing toner to offset to the fusing roll, as determined by the presence of previous images printed onto current images or the failure of the paper to release from the fuser roll) and the MFT. The gloss level of the fused toner layer (i.e., the shininess of the fused toner layer at a given fusing temperature as determined by industry standard light reflection measurement) is also dependent on the temperature at which the toner is fused, and can further restrict the fusing latitude; that is, if the gloss level of the toner becomes too high at a temperature below the HOT or too low at a temperature above the MFT this restricted range of temperatures will serve to define the fusing latitude.

The melt rheology profile of the toner must be optimized to give the lowest minimum fusing temperature and broadest fusing latitude. The melt rheology profile of the toner which is enabling in the present invention has a viscosity of between $3.9\times10^4$ and $6.7\times10^4$ Poise at a temperature of 97° C., a viscosity of between $4.0\times10^3$ and $1.6\times10^4$ Poise at a temperature of 116° C., and a viscosity of between $6.1\times10^2$ and $5.9\times10^3$ Poise at a temperature of 136° C. The melt rheology profile of the toner which is enabling in the present invention further has an elastic modulus of between $6.6\times10^5$ and $2.4\times10^6$ dynes per square centimeter at a temperature of 97° C., an elastic modulus of between $2.6\times10^4$ and $5.9\times10^5$ dynes per square centimeter at a temperature of 116° C., and an elastic modulus of between $2.7\times10^3$ and $3.0\times10^5$ dynes per square centimeter at a temperature of 136° C. Both the viscosity and elastic modulus are determined by measurement using a standard mechanical spectrometer at 40 radians per second. An alternate method of characterizing the toner rheology is by measurement of the melt flow index (MFI), defined as the weight of a toner (in grams) which passes through an orifice of length L and diameter D in a 10 minute period with a specified applied load. The melt rheology profile of the toner which is enabling in the present invention has an MFI of between 1 and 25 grams per 10 minutes, most preferably between 6 and 14 grams per 10 minutes at a temperature of 117° C., under an applied load of 2.16 kilograms with an L/D die ratio of 3.8. This narrow range of melt rheology profile will provide the required minimum fix, appropriate gloss and the desired hot offset behavior, enabling long fuser roll life.

C. Toner Storage/Vinyl and Document Offset

It has always been a requirement for xerographic toners to be able to be stored and shipped under varying environmental conditions without exhibiting toner blocking. It is well known that toner blocking is chiefly affected by the glass transition temperature (Tg) of the toner binder resin. This resin Tg is directly related to its chemical composition and molecular weight distribution. A resin must be chosen such that blocking is not experienced at typical storage temperatures, which defines the lower limit on Tg. As discussed above, the minimum fuse temperature and gloss must also be satisfied, which, to the extent that it affects melt rheology, defines the upper limit on Tg. The application of surface additives further raises the toner blocking temperature over that which is defined by the glass transition of the toner binder resin.

After documents are created, they are frequently stored in contact with vinyl surfaces such as used in file folders and three ring binders or in contact with the surface of other documents. Occasionally, finished documents are seen to adhere and offset to these surfaces, resulting in image degradation; this is known as vinyl offset in the case of offset to vinyl surfaces or document offset in the case of offset to other documents. Some toner binder resins are more susceptible to this phenomenon than others. The chemical composition of the toner binder resin and the addition of certain ingredients can minimize or prevent vinyl and document offset.

Therefore, it is desirable to choose a toner binder resin with a chemical composition that prevents vinyl and document offset, and possesses an appropriate range of glass transition temperature, to prevent toner blocking under storage without negatively affecting fusing properties.

To prevent blocking at typical storage temperatures, but still meet the required minimum fuse temperature, a resin should be chosen with a Tg on the range of from, for example, 52° C. to 64° C.

D. Toner Color

The toners must have the appropriate color characteristics to enable broad color gamut. The choice of colorants should enable rendition of a higher percentage of standard Pantone® colors than is typically available from 4-color xerography. Measurement of the color gamut is defined by CIE (Commission International de l'Éclairage ) specifications, commonly referred to as CIELab, where L*, a* and b* are the modified opponent color coordinates which form a 3 dimensional space, with L* characterizing the lightness of a color, a* approximately characterizing the redness, and b* approximately characterizing the yellowness of a color. The chroma C* is further defined as the color saturation, and is the square root of the sum of squares of a* and b*. For each toner, Chroma (C*) should be maximized over the entire range of toner mass on paper. Pigment concentration should be chosen so that maximum lightness (L*) corresponds with the desired toner mass on the substrate. All of these parameters are measured with an industry standard spectrophotometer (obtained, for instance, from X-Rite Corp.).

Therefore, it is desirable to choose toner colorants which, when combined, provide a broad set of colors on the print, that is, cover the broadest possible color space as defined in the CIELAB coordinate system, with the ability to render accurately desired pictorials, solids, halftones and text.

E. Toner Flow

It is well known that toner cohesivity can have detrimental effects on toner handling and dispensing. Toners with excessively high cohesion can exhibit "bridging" which prevents fresh toner from being added to the developer mixing system. Conversely, toners with very low cohesion can result in difficulty in controlling toner dispense rates and toner concentration, and can result in excessive dirt in the machine. In addition, in the HSD system, toner particles are first developed from a magnetic brush to two donor rolls. Toner flow must be such that the HSD wires and electric development fields are sufficient to overcome the toner adhesion to the donor roll and enable adequate image development to the photoreceptor. Following development to the photoreceptor, the toner particles must be able to be transferred from the photoreceptor to the substrate.

Therefore, it is desirable to tailor toner flow properties to minimize both cohesion of particles to one another, and adhesion of particles to surfaces such as the donor rolls and the photoreceptor. This provides reliable images due to high and stable development and high and uniform transfer.

The toner flow properties thus must minimize both cohesion of particles to one another, and adhesion of particles to surfaces such as the donor rolls and photoreceptor. Toner flow properties are most conveniently quantified by measurement of toner cohesion, for instance by placing a known mass of toner, for example two grams, on top of a set of three screens, for example with screen meshes of 53 microns, 45 microns, and 38 microns in order from top to bottom, and vibrating the screens and toner for a fixed time at a fixed vibration amplitude, for example for 90 seconds at a 1 millimeter vibration amplitude. A device to perform this measurement is a Hosokawa Powders Tester, available from Micron Powders Systems. The toner cohesion value is related to the amount of toner remaining on each of the screens at the end of the time. A cohesion value of 100% corresponds to all of the toner remaining on the top screen at the end of the vibration step and a cohesion value of zero corresponds to all of the toner passing through all three screens, that is, no toner remaining on any of the three screens at the end of the vibration step. The higher the cohesion value, the lesser the flowability of the toner. Minimizing the toner cohesion and adhesion will provide high and stable development and high and uniform transfer. Many additive combinations can provide adequate initial flow enabling development and transfer in HSD systems. It has been learned, however that high concentrations of relatively large external surface additives enable stable development and transfer over a broad range of area coverage and job run length.

F. Toner Charge

Toner charge distributions are correlated with development and transfer (including transfer efficiency and uniformity) performance. Print quality attributes that are affected by toner charge level include overall text quality (particularly the ability to render fine serifs), line growth/shrinkage, halo (a white region at the interface of two colors, also evident when text is embedded on a solid background), interactivity (toner of one color participating in the development process of another color, for instance by being scavenged from the printed area of a first color and being redeveloped into the printed area of a second color), background and highlight/shadow contrast (TRC). Failure modes identified with low toner charge include positive line shrinkage, negative line growth, halo, interactivity, background, poor text/serif quality, poor highlight contrast and machine dirt. Problems associated with high toner charge include low development, low transfer efficiency (high residual mass per unit area), poor shadow contrast and interactivity.

In addition to tailoring the average toner charge level, the distribution of charge must not contain excessive amounts of high or low (especially opposite polarity) toner charge. HSD is very sensitive to low charge toner since all of the toner that reaches the photoreceptor (both image and background) will be recharged during the process. Low charge toner (and certainly toner of the opposite polarity) will likely develop to the background region, and after recharging can be transferred to the print. Low charge toner also contributes to an accumulation of toner on the surface of the wires that are situated between the donor roll and photoreceptor in an HSD development system, which can cause differential development (spatially and temporally) leading to noticeable image quality defects, a condition called wire history. The distribution must also not contain excessive amounts of high charge toner, as this will reduce developability and transfer.

Additionally, the toner charge level and toner charge distribution must be maintained over a wide range of area coverage (AC) and job run length. Since the device of the invention is preferably a full color machine aimed at the offset market, AC and job run length will vary over a broad range. Print jobs such as annual reports will contain predominantly black text, with cyan, magenta and yellow used only for "spot color" applications such as logos, charts and graphs. For full color pictorials, the job can range from very light pastels, with mostly cyan, magenta and yellow, and very little black, to dark rich colors with high usage of cyan, magenta and yellow. In some scenarios, black will be used as replacement for equal amounts of cyan, magenta and yellow to reduce the overall toner layer thickness. Each scenario has a unique combination of AC for each of the colors cyan, magenta, yellow and black. Toner charge level and distribution cannot vary based on the corresponding average residence time of a toner in the housing (i.e., high AC=low residence time with a lot of turnover of toner in the housing; conversely low AC=high residence time).

It is desired that freshly added toner rapidly gains charge to the same level of the incumbent toner in the developer. If this is not the case, two distinct situations may occur. When freshly added toner fails to rapidly charge to the level of the toner already in the developer, a situation known as "slow admix" occurs. Distributions can be bimodal in nature, meaning that two distinct charge levels exist side-by-side in the development subsystem. In extreme cases, freshly added toner which has no net charge may be available for development onto the photoreceptor. Conversely, when freshly added toner charges to a level higher than that of toner already in the developer, a phenomenon known as "charge-thru" occurs. Also characterized by a bimodal distribution, in this case the low charge or opposite polarity toner is the incumbent toner (or toner that is present in the developer prior to the addition of fresh toner). The failure modes for both slow admix and charge-thru are the same as those for low charge toner state above, most notably background and dirt in the machine, wire history, interactivity, and poor text quality.

Therefore, it is desirable to design toner and developer materials to have an average toner charge level that avoids failure modes of both too high and too low toner charge.

This will preserve development of solids, halftones, fine lines and text, as well as prevention of background and image contamination. The distribution of toner charge level must be sufficiently narrow such that the tails of the distribution do not adversely affect image quality (i.e., the low charge population is not of sufficient magnitude so as to degrade the image quality attributes known to be related to low toner charge level). Toner charge level and distribution must be maintained over the full range of customer run modes (job run length and AC).

High average toner charge, and narrow charge distributions are required under all run conditions (area coverage and job run length) in the present invention. In the invention, appropriate additives as discussed below are chosen to enable high toner charge and charge stability.

The charge of a toner is described in terms of either the charge to particle mass, Q/M, in $\mu$C/g, or the charge/particle diameter, Q/D, in fC/$\mu$m following triboelectric contact of the toner with carrier particles. The measurement of Q/M is accomplished by the well-known Faraday Cage technique. The measurement of the average Q/D of the toner particles can be done by means of a charge spectrograph apparatus as well known in the art. The spectrograph is used to measure the distribution of the toner particle charge (Q in fC) with respect to a measured toner diameter (D in $\mu$m). The measurement result is expressed as percentage particle frequency (in ordinate) of same Q/D ratio on Q/D ratio expressed as fC/10 $\mu$m (in abscissa). The distribution of the frequency over Q/D values often takes the form of a Gaussian or Lorentzian distribution, with a peak position (most probably Q/D value) and peak width (characterized, for example, by the width of the peak in fC/$\mu$m at a frequency value of half of the peak value). From this full distribution an average Q/D value can be calculated. In certain circumstances the frequency distribution will consist of two or more distinct peaks, as in the slow admix and charge-thru behaviors discussed above.

In order to attain the print quality discussed above when used in an HSD developer apparatus of the preferred embodiment of the present invention, the Q/D of the toner particles must have an average value of from, for example, −0.1 to −1.0 fC/$\mu$m, preferably from about −0.5 to −1.0 fC/$\mu$m. This charge must remain stable throughout the development process in order to insure consistency in the richness of the images obtained using the toner. Thus, the toner charge should exhibit a change in the average Q/D value of at most from, for example, 0 to 0.25 fC/$\mu$m. The charge distribution of the toner, as measured by a charge spectrograph, should be narrow, that is possessing a peak width of less than 0.5 fC/$\mu$m, preferably less than 0.3 fC/$\mu$m, and unimodal, that is, possessing only a single peak in the frequency distribution, indicating the presence of no or very little low charge toner (too little charge for a sufficiently strong coulomb attraction) and wrong sign toner. Low charge toner should comprise no more than, for example, 6% of the total toner, preferably no more than 2%, while wrong sign toner should comprise no more than, for example, 3% of the total toner, preferably no more than 1%.

Using the complementary well known Faraday cage measurement, in order to attain the print quality discussed above when used in an HSD developer apparatus of the preferred embodiment of the present invention, the toner must also preferably exhibit a triboelectric value of from, for example, −25 to −70 $\mu$C/g, more preferably −30 to −60 $\mu$C/g. The tribo must be stable, varying at most from, for example, 0 to 15 $\mu$C/g, preferably from no more than 0 to 8 $\mu$C/g.

The print quality requirements for the HSD product translate into toner functional properties, as discussed above. By this invention, functionality is designed into the toners with the goal of meeting the many print quality requirements. Four different color toners, cyan (C), magenta (M), yellow (Y) and black (K), are typically used in developing full color images (although other color toners may also be used). Each of theses color toners in the present invention are preferably comprised of resin binder, appropriate colorants and an additive package comprised of one or more additives. Suitable and preferred materials for use in preparing toners of the invention that possess the properties discussed above will now be discussed. The specific formulations used to achieve the functional properties discussed above should not, however, be viewed as restricting the scope of the invention.

Illustrative examples of suitable toner resins selected for the toner and developer compositions of the present invention include vinyl polymers such as styrene polymers, acrylonitrile polymers, vinyl ether polymers, acrylate and methacrylate polymers; epoxy polymers; diolefins; polyurethanes; polyamides and polyimides; polyesters such as the polymeric esterification products of a dicarboxylic acid and a diol comprising a diphenol, crosslinked polyesters; and the like. The polymer resins selected for the toner compositions of the present invention include homopolymers or copolymers of two or more monomers. Furthermore, the above-mentioned polymer resins may also be crosslinked.

Polyester resins are among the preferred binder resins that are least affected by vinyl or document offset (Property C above).

Illustrative vinyl monomer units in the vinyl polymers include styrene, substituted styrenes such as methyl styrene, chlorostyrene, styrene acrylates and styrene methacrylates; vinyl esters like the esters of monocarboxylic acids including methyl acrylate, ethyl acrylate, n-butyl-acrylate, isobutyl acrylate, propyl acrylate, pentyl acrylate, dodecyl acrylate, n-octyl acrylate, 2-chloroethyl acrylate, phenyl acrylate, methylalphachloracrylate, methyl methacrylate, ethyl methacrylate, butyl methacrylate, propyl methacrylate, and pentyl methacrylate; styrene butadienes; vinyl chloride; acrylonitrile; acrylamide; alkyl vinyl ether and the like. Further examples include p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride and vinylidene chlorofluoride; N-vinyl indole, N-vinyl pyrrolidone; and the like Illustrative examples of the dicarboxylic acid units in the polyester resins suitable for use in the toner compositions of the present invention include phthalic acid, terephthalic acid, isophthalic acid, succinic acid, glutaric acid, adipic acid, pimelic acid, suberic acid, azelaic acid, sebacic acid, maleic acid, fumaric acid, dimethyl glutaric acid, bromoadipic acids, dichloroglutaric acids, and the like; while illustrative examples of the diol units in the polyester resins include ethanediol, propanediols, butanediols, pentanediols, pinacol, cyclopentanediols, hydrobenzoin, bis(hydroxyphenyl) alkanes, dihydroxybiphenyl, substituted dihydroxybiphenyls, and the like.

As one toner resin, there are selected polyester resins derived from a dicarboxylic acid and a diphenol. These resins are illustrated in U.S. Pat. No. 3,590,000, the disclosure of which is totally incorporated herein by reference. Also, polyester resins obtained from the reaction of bisphenol A and propylene oxide, and in particular including such polyesters followed by the reaction of the resulting product with fumaric acid, and branched polyester resins resulting from the reaction of dimethylterephthalate with 1,3-butanediol, 1,2-propanediol, and pentaerythritol may also preferable be used. Further, low melting polyesters, especially those prepared by reactive extrusion, reference U.S. Pat. No. 5,227,460, the disclosure of which is totally incorporated herein by reference, can be selected as toner resins. Other specific toner resins may include styrene-methacrylate copolymers, styrenebutadiene copolymers, PLIOLITES™, and suspension polymerized styrenebutadienes (U.S. Pat. No. 4,558,108, the disclosure of which is totally incorporated herein by reference).

More preferred resin binders for use in the present invention comprise polyester resins containing both linear portions and cross-linked portions of the type described in U.S. Pat. No. 5,227,460 (incorporated herein by reference above).

The cross-linked portion of the binder consists essentially of microgel particles with an average volume particle diameter up to 0.1 micron, preferably about 0.005 to about 0.1 micron, as determined by scanning electron microscopy and transmission electron microscopy, the microgel particles being substantially uniformly distributed throughout the linear portions. This resin may be prepared by a reactive melt mixing process as known in the art. The highly cross-linked dense microgel particles distributed throughout the linear portion impart elasticity to the resin, which improves the resin offset properties, while not substantially affecting the resin minimum fix temperature.

The toner resin is thus preferably a partially cross-linked unsaturated resin such as unsaturated polyester prepared by cross-linking a linear unsaturated resin (hereinafter called base resin) such as linear unsaturated polyester resin, preferably with a chemical initiator, in a melt mixing device such as, for example, an extruder at high temperature (e.g., above the melting temperature of the resin and preferably up to about 150° C. above that melting temperature) and under high shear.

The toner resin has a weight fraction of the microgel (gel content) in the resin mixture in the range typically from about 0.001 to about 50 weight percent, preferably from about 1 to about 20 weight percent, more preferably about 1 to about 10 weight percent, most preferably about 2 to 9 weight percent. The linear portion is comprised of base resin, preferably unsaturated polyester, in the range from about 50 to about 99.999 percent by weight of said toner resin, and preferably in the range from about 80 to about 98 percent by weight of said toner resin. The linear portion of the resin preferably comprises low molecular weight reactive base resin that did not cross-link during the cross-linking reaction, preferably unsaturated polyester resin.

The molecular weight distribution of the resin is thus bimodal, having different ranges for the linear and the cross-linked portions of the binder. The number-average molecular weight (Mn) of the linear portion as measured by gel permeation chromatography (GPC) is in the range of from, for example, about 1,000 to about 20,000, and preferably from about 3,000 to about 8,000. The weight-average molecular weight (Mw) of the linear portion is in the range of from, for example, about 2,000 to about 40,000, and preferably from about 5,000 to about 20,000. The weight average molecular weight of the gel portions is, on the other hand, generally greater than 1,000,000. The molecular weight distribution (Mw/Mn) of the linear portion is in the range of from, for example, about 1.5 to about 6, and preferably from about 1.8 to about 4. The onset glass transition temperature (Tg) of the linear portion as measured by differential scanning calorimetry (DSC) is in the range of from, for example, about 50° C. to about 70° C.

This binder resin can provide a low melt toner with a minimum fix temperature of from about 100° C. to about 200° C., preferably about 100° C. to about 160° C., more preferably about 110° C. to about 140° C., provide the low melt toner with a wide fusing latitude to minimize or prevent offset of the toner onto the fuser roll, and maintain high toner pulverization efficiencies. The toner resins and thus toners show minimized or substantially no vinyl or document offset.

In a preferred embodiment, the cross-linked portion consists essentially of very high molecular weight microgel particles with high density cross-linking (as measured by gel content) and which are not soluble in substantially any solvents such as, for example, tetrahydrofuran, toluene and the like. The microgel particles are highly cross-linked polymers with a very small, if any, cross-link distance. This type of cross-linked polymer may be formed by reacting chemical initiator with linear unsaturated polymer, and more preferably linear unsaturated polyester, at high temperature and under high shear. The initiator molecule breaks into radicals and reacts with one or more double bond or other reactive site within the polymer chain forming a polymer radical. This polymer radical reacts with other polymer chains or polymer radicals many times, forming a highly and directly cross-linked microgel. This renders the microgel very dense and results in the microgel not swelling very well in solvent. The dense microgel also imparts elasticity to the resin and increases its hot offset temperature while not affecting its minimum fix temperature.

Linear unsaturated polyesters used as the base resin are low molecular weight condensation polymers which may be formed by the step-wise reactions between both saturated and unsaturated diacids (or anhydrides) and dihydric alcohols (glycols or diols). The resulting unsaturated polyesters are reactive (e.g., cross-linkable) on two fronts: (i) unsaturation sites (double bonds) along the polyester chain, and (ii) functional groups such as carboxyl, hydroxy, etc., groups amenable to acid-base reactions. Typical unsaturated polyester base resins useful for this invention are prepared by melt polycondensation or other polymerization processes using diacids and/or anhydrides and diols. Suitable diacids and dianhydrides include but are not limited to saturated diacids and/or anhydrides such as for example succinic acid, glutaric acid, adipic acid, pimelic acid, suberic acid, azelaic acid, sebacic acid, isophthalic acid, terephthalic acid, hexachloroendo methylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and the like and mixtures thereof; and unsaturated diacids and/or anhydrides such as for example maleic acid, fumaric acid, chloromaleic acid, methacrylic acid, acrylic acid, itaconic acid, citraconic acid, mesaconic acid, maleic anhydride, and the like and mixtures thereof. Suitable diols include but are not limited to for example propylene glycol, ethylene glycol, diethylene glycol, neopentyl glycol, dipropylene glycol, dibromoneopentyl glycol, propoxylated bisphenol A, 2,2,4-trimethylpentane- 1,3-diol, tetrabromo bisphenol dipropoxy ether, 1,4-butanediol, and the like and mixtures thereof, soluble in good solvents such as, for example, tetrahydrofuran, toluene and the like.

Preferred unsaturated polyester base resins are prepared from diacids and/or anhydrides such as, for example, maleic anhydride, fumaric acid, and the like and mixtures thereof, and diols such as, for example, propoxylated bisphenol A, propylene glycol, and the like and mixtures thereof. A particularly preferred polyester is poly(propoxylated bisphenol A fumarate).

In a most preferred embodiment of the present invention, the toner binder resin comprises a melt extrusion of (a) linear propoxylated bisphenol A flimarate resin and (b) this resin cross-linked by reactive extrusion of this linear resin, with the resulting extrudate comprising a resin with an overall gel content of from about 2 to about 9 weight percent. Linear propoxylated bisphenol A fumarate resin is available under the tradename SPARII from Resana S/A Industrias Quimicas, Sao Paulo Brazil, or as Neoxyl P2294 or P2297 from DSM Polymer, Geleen, The Netherlands, for example. For suitable toner storage and prevention of vinyl and document offset, the polyester resin blend preferably has Tg range of from, for example, 52 to 64° C. Using resin having only the linear portion of the propoxylated bisphenol A fumarate resin does not attain the needed melt rheology profile.

Chemical initiators such as, for example, organic peroxides or azo-compounds are preferred for making the cross-linked toner resins of the invention. Suitable organic peroxides include diacyl peroxides such as, for example, decanoyl peroxide, lauroyl peroxide and benzoyl peroxide, ketone peroxides such as, for example, cyclohexanone peroxide and methyl ethyl ketone, alkyl peroxyesters such as, for example, t-butyl peroxy neodecanoate, 2,5-dimethyl 2,5-di (2-ethyl hexanoyl peroxy) hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di (benzoyl peroxy) hexane, oo-t-butyl o-(2-ethyl hexyl) mono peroxy carbonate, and oo-t-amyl o-(2-ethyl hexyl) mono peroxy carbonate, aikyl peroxides such as, for example, dicumyl peroxide, 2,5-dimethyl 2,5-di (t-butyl peroxy) hexane, t-butyl cumyl peroxide, bis(t-butyl peroxy) diisopropyl benzene, di-t-butyl peroxide and 2,5-dimethyl 2,5-di (t-butyl peroxy) hexyne-3, alkyl hydroperoxides such as, for example, 2,5-dihydro peroxy 2,5-dimethyl hexane, cumene hydroperoxide, t-butyl hydroperoxide and t-amyl hydroperoxide, and alkyl peroxyketals such as, for example, n-butyl 4,4-di (t-butyl peroxy) valerate, 1,1-di (t-butyl peroxy) 3,3,5-trimethyl cyclohexane, 1,1-di (t-butyl peroxy) cyclohexane, 1,1-di (t-amyl peroxy) cyclohexane, 2,2-di (t-butyl peroxy) butane, ethyl 3,3-di (t-butyl peroxy) butyrate, ethyl 3,3-di (t-amyl peroxy) butyrate and 1,1-bis (t-butyl(peroxy) 3,3,5-trimethylcyclohexane. Suitable azo-compounds include azobis-isobutyronitrile, 2,2'-azobis (isobutyronitrile), 2,2'-azobis (2,4-dimethyl valeronitrile), 2,2'-azobis (methyl butyronitrile), 1,1'-azobis (cyano cyclohexane) and other similar known compounds.

By permitting use of low concentrations of chemical initiator and utilizing all of it in the cross-linking reaction, usually in the range from about 0.01 to about 10 weight percent, and preferably in the range from about 0.1 to about 4 weight percent, the residual contaminants produced in the cross-linking reaction in preferred embodiments can be minimal. Since the cross-finkng can be carried out at high temperature, the reaction is very fast (e.g., less than 10 minutes, preferably about 2 seconds to about 5 minutes) and thus little or no unreacted initiator remains in the product.

The low melt toners and toner resins may be prepared by a reactive melt mixing process wherein reactive resins are partially cross-linked. For example, low melt toner resins may be fabricated by a reactive melt mixing process comprising the steps of: (1) melting reactive base resin, thereby forming a polymer melt, in a melt mixing device; (2) initiating cross-linking of the polymer melt, preferably with a chemical cross-linking initiator and increased reaction temperature; (3) keeping the polymer melt in the melt mixing device for a sufficient residence time that partial cross-linking of the base resin may be achieved; (4) providing sufficiently high shear during the cross-linking reaction to keep the gel particles formed and broken down during shearing and mixing and well distributed in the polymer melt; (5) optionally devolatilizing the polymer melt to remove any effluent volatiles; and (6) optionally adding additional linear base resin after the cross-linking in order to achieve the desired level of gel content in the end resin. The high temperature reactive melt mixing process allows for very fast cross-linking which enables the production of substantially only microgel particles, and the high shear of the process prevents undue growth of the microgels and enables the microgel particles to be uniformly distributed in the resin.

A reactive melt mixing process is a process wherein chemical reactions can be carried out on the polymer in the melt phase in a melt mixing device, such as an extruder. In preparing the toner resins, these reactions are used to modify the chemical structure and the molecular weight, and thus the melt rheology and fusing properties, of the polymer. Reactive melt mixing is particularly efficient for highly viscous materials, and is advantageous because it requires no solvents, and thus is easily environmentally controlled. As soon as the amount of cross-linking desired is achieved, the reaction products can be quickly removed from the reaction chamber.

The resins are generally present in the toner of the invention in an amount of from about 40 to about 98 percent by weight, and more preferably from about 70 to about 98 percent by weight, although they may be present in greater or lesser amounts, provided that the objectives of the invention are achieved.

The toner resins can be subsequently melt blended or otherwise mixed with a colorant, charge carrier additives, surfactants, emulsifiers, pigment dispersants, flow additives, embrittling agents, and the like. The resultant product can then be pulverized by known methods such as milling to form toner particles. If desired, waxes with a molecular weight of from about 1,000 to about 7,000, such as polyethylene, polypropylene, and paraffin waxes, can be included in, or on the toner compositions as fusing release agents.

Various suitable colorants of any color without restriction can be employed in toners of the invention, including suitable colored pigments, dyes, and mixtures thereof including Carbon Black, such as Regal 330 carbon black (Cabot), Acetylene Black, Lamp Black, Aniline Black, Chrome Yellow, Zinc Yellow, Sicofast Yellow, Sunbrite Yellow, Luna Yellow, Novaperm Yellow, Chrome Orange, Bayplast Orange, Cadmium Red, Lithol Scarlet, Hostaperm Red, Fanal Pink, Hostaperm Pink, Lithol Red, Rhodamine Lake B, Brilliant Carmine, Heliogen Blue, Hostaperm Blue, Neopan Blue, PV Fast Blue, Cinquassi Green, Hostaperm Green, titanium dioxide, cobalt, nickel, iron powder, Sicopur 4068 FF, and iron oxides such as Mapico Black (Columbia), NP608 and NP604 (Northern Pigment), Bayferrox 8610 (Bayer), MO8699 (Mobay), TMB-100 (Magnox), mixtures thereof and the like.

The colorant, preferably black, cyan, magenta and/or yellow colorant, is incorporated in an amount sufficient to impart the desired color to the toner. In general, pigment or dye is employed in an amount ranging from about 2 to about 60 percent by weight, and preferably from about 2 to about 9 percent by weight for color toner and about 3 to about 60 percent by weight for black toner.

For the black toner of the invention, the black toner must contain a suitable black pigment so as to provide a Lightness (or L*) no greater than 17 at the operating TMA. In a most preferred embodiment, carbon black is used at a loading of 5% by weight. Carbon black is preferred.

For the cyan toner of the invention, the toner should contain a suitable cyan pigment type and loading so as to enable as broad a color gamut as is achieved in benchmark lithographic four-color presses. In a most preferred embodiment, the pigment is comprised of 30% PV Fast Blue (Pigment Blue 15:3) from SUN dispersed in 70% linear propoxylated bisphenol A fuimarate and is loaded into the toner in an amount of 11% by weight (corresponding to about 3.3% by weight pigment loading).

For the yellow toner of the invention, the toner should contain a suitable yellow pigment type and loading so as to enable as broad a color gamut as is achieved in benchmark lithographic four-color presses. In a most preferred embodiment, the pigment is comprised of 30% Sunbrite Yellow (Pigment Yellow 17) from SUN dispersed in 70% linear propoxylated bisphenol A fumarate and is loaded into the toner in an amount of about 27% by weight (corresponding to about 8% by weight pigment loading).

For the magenta toner of the invention, the toner should contain a suitable magenta pigment type and loading so as to enable as broad a color gamut as is achieved in benchmark lithographic four-color presses. In a most preferred embodiment, the pigment is comprised of 40% Fanal Pink (Pigment Red 81:2) from BASF dispersed in 60% linear propoxylated bisphenol A fumarate and is loaded into the toner in an amount of about 12% by weight (corresponding to about 4.7% by weight pigment loading).

Any suitable surface additives may be used in the present invention. Most preferred in the present invention are one or more of $SiO_2$, metal oxides such as, for example, $TiO_2$ and aluminum oxide, and a lubricating agent such as, for example, a metal salt of a fatty acid (e.g., zinc stearate (ZnSt), calcium stearate) or long chain alcohols such as Unolin 700, as external surface additives. In general, silica is applied to the toner surface for toner flow, tribo enhancement, admix control, improved development and transfer stability and higher toner blocking temperature. $TiO_2$ is applied for improved relative humidity (RH) stability, tribo control and improved development and transfer stability.

The $SiO_2$ and $TiO_2$ should preferably have a primary particle size greater than approximately 30 nanometers, preferably of at least 40 nm, with the primary particles size measured by, for instance transmission electron microscopy (TEM) or calculated (assuming spherical particles) from a measurement of the gas absorption, or BET, surface area. $TiO_2$ is found to be especially helpful in maintaining development and transfer over a broad range of area coverage and job run length. The $SiO_2$ and $TiO_2$ are preferably applied to the toner surface with the total coverage of the toner ranging from, for example, about 140 to 200% theoretical surface area coverage (SAC), where the theoretical SAC (hereafter referred to as SAC) is calculated assuming all toner particles are spherical and have a diameter equal to the volume median diameter of the toner as measured in the standard Coulter counter method, and that the additive particles are distributed as primary particles on the toner surface in a hexagonal closed packed structure. Another metric relating to the amount and size of the additives is the sum of the "SAC×Size" (surface area coverage times the primary particle size of the additive in nanometers) for each of the silica and titania particles or the like, for which all of the the additives should preferably have a total SAC×Size range of between, for example, 4500 to 7200. The ratio of the silica to titania particles is generally between 50% silica/50% titania and 85% silica/15% titania, (on a weight percentage basis), although the ratio may be larger or smaller than these values, provided that the objectives of the invention are achieved. Toners with lesser SAC×Size could potentially provide adequate initial development and transfer in HSD systems, but may not display stable development and transfer during extended runs of low area coverage (low toner throughput).

The most preferred $SiO_2$ and $TiO_2$ have been surface treated with compounds including DTMS (dodecyltrimethoxysilane) or HMDS (hexamethyldisilazane). Examples of these additives are: NA50HS silica, obtained from DeGussa/Nippon Aerosil Corporation, coated with a mixture of HMDS and aminopropyltriethoxysilane; DTMS silica, obtained from Cabot Corporation, comprised of a fumed silica, for example silicon dioxide core L90 coated with DTMS; H2050EP, obtained from Wacker Chemie, coated with an amino functionalized organopolysiloxane; and SMT5103, obtained from Tayca Corporation, comprised of a crystalline titanium dioxide core MT500B, coated with DTMS.

Zinc stearate is preferably also used as an external additive for the toners of the invention, the zinc stearate providing lubricating properties. Zinc stearate provides developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. Most preferred is a commercially available zinc stearate known as Zinc Stearate L, obtained from Ferro Corporation, which has an average particle diameter of about 9 microns, as measured in a Coulter counter.

Most preferably, the toners contain from, for example, about 0.1 to 5 weight percent titania, about 0.1 to 8 weight percent silica and about 0.1 to 4 weight percent zinc stearate.

The additives discussed above are chosen to enable superior toner flow properties, as well as high toner charge and charge stability. The surface treatments on the $SiO_2$ and $TiO_2$, as well as the relative amounts of the two additives, can be manipulated to provide a range of toner charge.

For further enhancing the positive charging characteristics of the developer compositions described herein, and as optional components there can be incorporated into the toner or on its surface charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; bisulfates, and the like and other similar known charge enhancing additives. Also, negative charge enhancing additives may also be selected, such as aluminum complexes, like BONTRON E-88, and the like. These additives may be incorporated into the toner in an amount of from about 0.1 percent by weight to about 20 percent by weight, and preferably from 1 to about 3 percent by weight.

The toner composition of the present invention can be prepared by a number of known methods including melt blending the toner resin particles, and pigment particles or colorants followed by mechanical attrition. Other methods include those well known in the art such as spray drying, melt dispersion, dispersion polymerization, suspension polymerization, and extrusion.

The toner is preferably made by first mixing the binder, preferably comprised of both the linear resin and the cross-linked resin as discussed above, and the colorant together in a mixing device, preferably an extruder, and then extruding the mixture. The extruded mixture is then preferably micronized in a grinder along with about 0.3 to about 0.5 weight percent of the total amount of silica to be used as an external additive. The toner is then classified to form a toner with the desired volume median particle size and percent fines as discussed above. Care should also be taken in the method in order to limit the coarse particles, grits and giant particles. Subsequent toner blending of the remaining external additives is preferably accomplished using a mixer or blender, for example a Henschel mixer, followed by screening to obtain the final toner product.

In a most preferred embodiment, the process is carefully controlled and monitored in order to consistently achieve toners having the necessary properties discussed above. First, the ingredients are fed into the extruder in a closed loop system from hoppers containing, respectively, the linear resin, the cross-linked resin, the predispersed pigment (i.e., the pigment dispersed in a portion of binder such as linear propoxylated bisphenol A flumarate and is as discussed above) and reclaimed toner fines.

Reclaimed toner fines are those toner particles that have been removed from previously made toner during classification as being too small. As this can be a large percentage of material, it is most preferred to recycle this material back into the method as reclaimed toner fines. This material thus already contains the resins and the colorant, as well as any additives introduced into the toner at the extrusion, grinding, or classification processes. It may comprise anywhere from about 5 to about 50% by weight of the total material added into the extruder.

As the extrudate passes through the die, it is monitored with one or more monitoring devices that can provide feedback signals to control the amounts of the individual materials added into the extruder so as to carefully control the composition and properties of the toner, and thus ensure that a consistent product is obtained. This is quite significant in the present invention, where tight toner functional properties are required as discussed above.

Most preferably, the extrudate is monitored with both an on-line rheometer and a near IR spectrophotometer as the monitoring devices. The on-line rheometer evaluates the melt rheology of the product extrudate and provides a feedback signal to control the amount of linear and cross-linked resin being dispensed. For example, if the melt rheology is too high, the signal indicates that the amount of linear resin added relative to the cross-linked resin should be increased. This monitoring provides control of the toner melt rheology, one of the properties that must be met in order for the performance in an HSD device to be maximized as discussed above.

The near IR spectrophotometer, used in transmission mode, can distinguish between the colors as well as monitor colorant concentration. The spectrophotometer can be used to generate a signal to appropriately adjust the amount of colorant added into the extruder. This monitoring provides control over the amount of pigmentation and thereby enables the functionality of toner chroma and can also identify color cross-contamination. By this monitoring, any out-of-specification product can be intercepted at the point of monitoring and purged from the line while in-specification product can continue downstream to the grinding and classification equipment.

In grinding, the addition of a portion of the total amount of silica to be added facilitates the grind and class operations. Specifically, injection into the grinder of between 0.1 and 1.0% of an silica or metal oxide flow aid decreases the level of variability in the output of the grinding operation, allowing better control of the grinding process and allowing it to operate at an optimized level. Additionally, this process enhances the jetting rate of the toner by between 10 and 20 percent. When the toner which is ground in this manner is classified to remove the fine portion of the toner particles, the classification yield and throughput rate are improved which helps control costs during the classification step where very tight control over particle size and distribution must be maintained for the toner to achieve the properties discussed above.

Classified toner product is then blended with the external surface additives in a manner to enable even distribution and firm attachment of the surface additives, for example by using a high intensity blender. The blended toner achieved has the appropriate level and stability of toner flow and triboelectric properties.

The resulting toner particles can then be formulated into a developer composition. Preferably, the toner particles are mixed with carrier particles to achieve a two-component developer composition.

To meet the print quality attributes discussed above, developer materials must operate in a consistent, predictable manner the same as the toner materials as discussed above. The most significant developer material parameters enabling the toners to so operate, particularly in the hybrid scavengeless development system atmosphere, are developer charge, developer conductivity, developer toner concentration, mass flow and bulk density of the developer, carrier size distribution, carrier magnetic properties and chroma shift.

Below are listed the developer material parameters and the print quality attributes that the parameters influence. Preferred values for the various properties are also described.

G. Developer Charge

The developer charge is correlated with development and transfer (including transfer efficiency and uniformity) performance the same way as the toner charge of the toner (Property F) is as discussed above.

Therefore, again, it is desirable to design toner and developer materials to have an average toner charge level that avoids failure modes of both too high and too low toner charge. This will preserve development of solids, halftones, fine lines and text, as well as prevention of background and image contamination. The distribution of developer and toner charge level must be sufficiently narrow such that the tails of the distribution do not adversely affect image quality (i.e., the low charge population is not of sufficient magnitude so as to degrade the image quality attributes known to be related to low toner charge level). Developer and toner charge level and distribution must be maintained over the full range of customer run modes (job run length and AC).

As in the case of toner charge (Section F), the charge of a toner in the developer is described in terms of either the charge to particle mass, Q/M, in $\mu$C/g, or the charge/particle diameter, Q/D, in fC/$\mu$m following triboelectric contact of the toner with carrier particles. The measurement of Q/M is accomplished by the wellknown Faraday Cage technique.

The measurement of the average Q/D of the toner particles, as well as the full distribution of Q/D values, can be done by means of a charge spectrograph apparatus as well known in the art. In order to attain the print quality discussed above when used in an HSD developer apparatus of the preferred embodiment of the present invention, the Q/D of the toner particles in the developer must have an average value of from, for example, −0.1 to −1.0 fC/μm, preferably from about −0.5 to −1.0 fC/μm. This charge must remain stable throughout the development process in order to insure consistency in the richness of the images obtained using the toner. Thus, the toner charge should exhibit a change in the average Q/D value of at most from, for example, 0 to 0.25 fC/μm. The charge distribution of the toner in the developer, as measured by a charge spectrograph, should be narrow, that is possessing a peak width of less than 0.5 fC/μm, preferably less than 0.3 fC/μm, and unimodal, that is, possessing only a single peak in the frequency distribution, indicating the presence of no or very little low charge toner (too little charge for a sufficiently strong coulomb attraction) and wrong sign toner. Low charge toner should comprise no more than, for example, no more than 15% of the total number of toner particles, preferably no more than 6% of the total toner, more preferably no more than 2%, while wrong sign toner should comprise no more than, for example, 5% of the total number of toner particles, preferably no more than 3% of the total toner, more preferably no more than 1%. Using the complementary well known Faraday cage measurement, the toner in the developer must also preferably exhibit a triboelectric value of from, for example, −25 to −70 μC/g, more preferably −35 to −60 μC/g. The tribo must be stable, varying at most from, for example, 0 to 15 μC/g, preferably from no more than 0 to 8 μC/g, during development with the toner, for example during development in an HSD system.

The carrier core and coating, as well as the toner additives discussed above, are all chosen to enable high developer charge and charge stability. The processing conditions of the carrier, as well as the levels of toner additives selected, can be manipulated to affect the developer charging level.

H. Developer Conductivity

A hybrid scavengeless development system uses a magnetic brush of a conventional two component system in conjunction with a donor roll used in typical single component systems to transfer toner from the magnetic brush to the photoreceptor surface. As a result, the donor roll must be completely reloaded with toner in just one revolution. The inability to complete reloading of the donor roll in one revolution will result in a print quality defect called reload. This defect is seen on prints as solid areas that become lighter with successive revolutions of the donor roll, or alternately if the structure of an image from one revolution of the donor roll is visible in the image printed by the donor roll on its next revolution, a phenomenon known as ghosting in the art related to single component xerographic development. Highly conductive developers aid in the reduction of this defect. The more conductive developers allow for the maximum transfer of toner from the magnetic brush to the donor roll. Therefore, it is desirable to select developer materials which when combined, are conductive enough to reload the donor roll in a single revolution.

The conductivity of the developer is primarily driven by the carrier conductivity. To achieve the most conductive carrier possible, electrically conductive carrier cores, for example atomized steel cores, with partial coatings of electrically insulating polymers to allow a level of exposed carrier core, are used. An alternative technology of using conductive polymers to coat the carrier core is also feasible. Additionally, irregularly shaped carrier cores provide valleys into which the polymer coating may flow, leaving exposed asperities for more conductive developers. Irregularly shaped carrier cores also function to allow toner particles to contact the surface of the carrier core in the valleys to provide charge to the toner while not interfering with the contact between the uncoated carrier asperities which provides the overall developer conductivity. The addition of zinc stearate to the toner additive package also assists in the lubrication of the carrier and toner, increasing the number of contacts between carrier and toner particles.

Preferably, the conductivity of the developer ranges from, for example, between $10^{-11}$ and $10_{-14}$ (ohm-cm)$_{-1}$, at a toner concentration of between 3.5 and 5.5 percent by weight as measured, for example, across a 0.1 inch magnetic brush at an applied potential of 30 volts. At a toner concentration of between 0 and 0.5 percent, that is bare carrier or carrier that has only a small amount of residual toner on the surface, the carrier has a conductivity of between $10^{-8}$ and $10^{-12}$ (ohm-cm)$^{-1}$as measured under the same conditions.

I. Developer Toner Concentration

The requirement of the toner concentration level is determined by the requirements of machine set-up. It is therefore critical to be able to blend a developer that will meet the required toner concentration, and control, the concentration of toner to the desired level.

Preferably, the toner concentration ranges from, for example, 1 to 6%, more preferably 3.5 to 5.5%, by weight of the total weight of the developer.

J. Chroma Shift

The toners must have the appropriate color characteristics to enable broad color gamut. The choice of colorants enable the rendition of a higher percentage of standard Pantone® colors than is typically available from four-color xerography. For each toner, chroma (C*) must be maximized, and it is very important to have the color remain accurate relative to the requested color. Materials in the developer housing can cause the color of the toner to shift as a fimction of developer age, print area coverage, or other machine operating conditions, which is measured via the difference between the target color and the actual color, specifically as $\Delta E_{CMC}$, (where CMC stands for the Color Measurement Committee of the Society of Dyers and Colorists) which calculates the color change in the three dimensional L*, a*, b* CIELAB space defined in section D. The carrier may contribute to the variation in color, or chroma shift, but may only cause a shift of about $\pm\frac{1}{3}\Delta E_{CMC}$ units. Therefore, it is critical to select carrier cores and carrier core coatings that do not contribute to chroma shift of the toner as a fimction of the state of the developer.

Carrier core and coating polymers must be chosen such that they are lightly colored or colorless and are mechanically robust to the wear experienced in the developer housing. This will prevent a change in $\Delta E_{CMC}$ performance should the carrier coating become abraded. The coating polymer and core should also be robust to mechanical wear that will be experienced in the developer housing. Robustness of the coating polymer would allow the use of darker colored additives to be utilized in the carrier coating without the risk of chroma shift.

Preferably, the $\Delta E_{CMC}$ exhibited over all machine and developer running conditions in all customer environments using the developer and toner of the invention ranges from at most, for example, 0 to 0.60, more preferably from at most, for example, 0 to 0.30.

K. Carrier Size Distribution

Given the small toner size discussed above, it is desirable to also move to a smaller carrier size in order to maintain a ratio of carrier volume median diameter to toner volume median diameter of about 10:1, with the toner volume median as determined by the well known Coulter counter technique and the carrier volume median diameter as determined by well known laser diffraction techniques. This ratio enables a $TC_0$ on the order of 1. This $TC_0$ of 1 translates into a greater tribo sensitivity to toner concentration. This therefore allows the machine control system to use toner concentration as a tuning knob for tribo in the housing. It is also important to maintain a low level of fines in the carrier in order to prevent bead carry-out onto the prints, which generally leads to a print quality defect known as debris-centered deletions (DCDs). Therefore, it is desirable to control the carrier particle size and limit the amount of fine carrier particles.

Given the small toner size discussed above, it is desirable to also move to a smaller size carrier size in order to maintain a ratio of carrier volume median diameter to toner volume median diameter of approximately 10:1. The carrier particles thus should have an average particle size (diameter) of from, for example, about 65 to about 90 microns, preferably from 70 to 84 microns. The fine side of the carrier distribution is well controlled with only about 2.0% of the weight distribution having a size less than 38 microns.

In addition, the developer should exhibit consistent and stable developability, for example exhibiting a stable developed toner mass per unit area (DMA) on the photoreceptor, with a target in the range of between, 0.4 to 1.0 mg/cm$^2$, as measured directly by removal of the toner in given area from the photoreceptor and subsequent weighing or as determined indirectly by a calibrated reflectance measurement from the photoreceptor, at the operational voltages of the development device (for example, at a wire voltage of 200 V in an HSD development device), and a variation of the DMA from the target value of at most 0.4 mg/cm$^2$, most preferably of at most 0.2 mg/cm$^2$. The developer must also exhibit high transfer efficiency to the image receiving substrate with very low residual toner left on the photoreceptor surface following transfer.

The print quality requirements for the HSD product translate into developer functional properties, as discussed above. By this invention, functionality is designed into the toners and developers with the goal of meeting the many print quality requirements. Suitable and preferred materials for use as carriers used in preparing developers containing the above-discussed toners of the invention that possess the properties discussed above will now be discussed.

Illustrative examples of carrier particles that can be selected for mixing with the toner composition prepared in accordance with the present invention include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Additionally, there can be selected as carrier particles nickel berry carriers as disclosed in U.S. Pat. No. 3,847,604, the entire disclosure of which is hereby totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are hereby totally incorporated herein by reference.

In a most preferred embodiment, the carrier core is comprised of atomized steel available commercially from, for example, Hoeganaes Corporation.

The selected carrier particles can be used with or without a coating, the coating generally being comprised of fluoropolymers, such as polyvinylidene fluoride resins, terpolymers of styrene, methyl methacrylate, a silane, such as triethoxy silane, etrafluorethylenes, other known coatings and the like.

In a most preferred embodiment, the carrier core is partially coated with a polymethyl methacrylate (PMMA) polymer having a weight average molecular weight of 300,000 to 350,000 commercially available from Soken. The PMMA is an electropositive polymer in that the polymer that will generally impart a negative charge on the toner with which it is contacted.

The PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like.

The carrier particles may be prepared by mixing the carrier core with from, for example, between about 0.05 to about 10 percent by weight, more preferably between about 0.05 percent and about 3 percent by weight, based on the weight of the coated carrier particles, of polymer in until adherence thereof to the carrier core by mechanical impaction and/or electrostatic attraction.

The polymer is most preferably applied in dry powder form and having an average particle size of less than 1 micrometer, preferably less than 0.5 micrometers.

Various effective suitable means can be used to apply the polymer to the surface of the carrier core particles. Examples of typical means for this purpose include combining the carrier core material and the polymer by cascade roll mixing, or tumbling, milling, shaking, electrostatic powder cloud spraying, fluidized bed, electrostatic disc processing, and with an electrostatic curtain.

The mixture of carrier core particles and polymer is then heated to a temperature below the decomposition temperature of the polymer coating. For example, the mixture is heated to a temperature of from about 90° C. to about 350° C., for a period of time of from, for example, about 10 minutes to about 60 minutes, enabling the polymer to melt and fuse to the carrier core particles. The coated carrier particles are then cooled and thereafter classified to a desired particle size. The coating preferably has a coating weight of from, for example, 0.1 to 3.0% by weight of the carrier, preferably 0.5 to 1.3% by weight.

In a further most preferred embodiment of the invention, the polymer coating of the carrier core is comprised of PMMA, most preferably PMMA applied in dry powder form and having an average particle size of less than 1 micrometer, preferably less than 0.5 micrometers, that is applied (melted and fused) to the carrier core at higher temperatures on the order of 220° C. to 260° C. Temperatures above 260° C. may adversely degrade the PMMA. Triboelectric tunability of the carrier and developers of the invention is provided by the temperature at which the carrier coating is applied, higher temperatures resulting in higher tribo up to a point beyond which increasing temperature acts to degrade the polymer coating and thus lower tribo.

With higher tribo, longer development life and improvement in fringe field development is expected.

As discussed above, it is desirable to maintain a ratio of carrier volume median diameter to toner volume median diameter of approximately 10:1. The carrier particles thus should have an average particle size (volume median diameter) of from, for example, about 65 to about 90 microns, preferably from 70 to 89 microns, most preferably from 75 to 85 microns. The size distribution of the carrier particles is further defined such that no more than 10 percent of the carrier particles by weight should have a diameter of less than 50 microns and no more than 10 percent of the carrier particles by weight should have a diameter of greater than 120 microns. The fine side of the carrier distribution is well controlled with only about 2.0% of the weight distribution having a size less than 38 microns, preferably only 1.0% of the weight distribution having a size less than 38 microns.

The carrier particles can be mixed with the toner particles in various suitable combinations. However, best results are obtained when about 1 part to about 5 parts by weight of toner particles are mixed with from about 10 to about 300 parts by weight of the carrier particles, preferably when 3.4 to 5.3 parts by weight of toner particles are mixed with from 90 to 110 parts by weight of the carrier particles. The toner concentration in the developer composition is thus preferably between 3.0 and 5.5% by weight.

In a still further preferred embodiment of the present invention, it has been found that using a carrier core having a shape factor greater than 6 is preferred. The shape factor as used herein is defined as the ratio of BET surface area to the equivalent sphere surface area (ESSA) calculated using the volume median diameter, as measured above by standard laser diffraction techniques, of the core particle. It represents a measure of the surface morphology of the carrier core.

It has been found as an aspect of this invention that carrier conductivity is driven strongly by the core BET surface area, while the triboelectric properties are not strongly affected by the BET surface area.

It is useful to express the surface characteristics of a carrier core not by BET surface area alone, which is specific to a particular core size and density, but by a shape factor which is calculated by dividing the BET surface area by the theoretical surface area of a carrier core assuming a smooth spherical surface. The theoretical surface area, also referred to as the equivalent sphere surface area (ESSA), calculated using the volume median diameter of the core particle is given by $$\text{ESSA}=\text{surface area of bead}/(\text{volume of bead}\times\text{density of bead})$$

$$=4\pi r^2/((4\pi/3)r^3\times d)$$

$$=3/rd$$

where r is the radius of the core based on laser diffraction measurement, using for instance a Mastersizer X, available from Malvern Instruments Ltd. and d is the density of the core. For the preferred atomized steel of the invention, the density is 7 g/cm$^3$.

Thus, for a carrier core having a size of, for example, 77 microns, the ESSA is 55.7 cm$^2$/g, derived from ($3/(77\times10^{-4}$ $\mu$m$\times$7 g/cm$^3$)).

The core shape factor is a unitless number since it is the core BET surface area divided by the ESSA. As the core shape factor increases, the surface morphology of the core becomes more irregular. It is most preferred to use a carrier core having a shape factor of greater than 6.0, preferably greater than 6.8, and most preferably of 7.0 or more. Cores with such shape factor have not only excellent conductivity (for example, above $10^{-12}$ mho/cm), but also superior tribo. The most preferred atomized steel available commercially from Hoeganaes Corporation has a shape factor of 7.9.

What is claimed is:

1. A replenisher material comprised of toner particles and carrier particles, wherein a replenisher ratio of the toner particles to the carrier particles in the replenisher material is determined as a function of at least one property of a developer and at least one corresponding minimum operational property of an apparatus for developing an electrostatic latent image recorded on an image receiving medium with the developer, and wherein the apparatus comprises:

a housing defining a chamber having a supply of developer comprised of toner particles and carrier particles therein, a donor member spaced from the image receiving member and adapted to transport toner particles of the developer from the chamber to a development zone adjacent the image receiving member, at least one wire positioned in the development zone between the image receiving member and the donor member, a voltage supply for electrically biasing the at least one wire during a developing operation with a current to detach toner particles from the donor member, forming a cloud of toner particles in the development zone, and developing the latent image with toner particles from the cloud, and at least one dispenser for dispensing replenisher material into the chamber.

2. The replenisher according to claim 1, wherein the replenisher ratio is determined as a function of the tribo stability of the developer in a non-replenishment mode of the apparatus.

3. The replenisher according to claim 2, wherein the tribo stability of the developer is specified in terms of the replenisher ratio required in order to meet a minimum $A_T$ value of the apparatus according to the equation $$R_R=(YMK_A((A_1/(A_0-A_{min}))-1))^{-1}$$

where $R_R$=Replenisher ratio (g of toner/g of carrier in replenisher)

Y=Toner yield (kp/g of toner)

M=Mass of material in the developer chamber (g)

$K_A$=Exponential decay constant in a non-trickle mode (1/kp)

$A_1$=Range of $A_T$ decay from t=0 to t=infinity $A_0$=$A_T$ level at t=0

$A_{min}$=Minimum $A_T$ value of the apparatus.

4. The replenisher according to claim 3, wherein the minimum $A_T$ level of the apparatus ranges from 140 to 165 $\mu$C/g times % toner.

5. The replenisher according to claim 3, wherein the exponential decay constant in the non-replenishment mode is derived from data on $A_T$ decay over time for different replenisher ratios.

6. The replenisher according to claim 1, wherein the replenisher ratio ranges from 2:1 to 8:1 parts by weight.

7. The replenisher according to claim 1, wherein the replenisher ratio is about 3:1 parts by weight.

8. The replenisher according to claim 2, wherein the replenisher ratio is further determined as a function of the conductivity of the developer in a non-replenishment mode of the apparatus.

9. The replenisher according to claim 8, wherein the conductivity of the developer is specified in terms of the replenisher ratio required in order to meet a minimum $\sigma$ value of the apparatus according to the equation $$R_R=(YMK_\sigma((\sigma_0/(\sigma_0-\sigma_{min}))-1))^{-1}$$

where $R_R$=Replenisher ratio (g of toner/g of carrier in replenisher)

Y=Toner yield (kp/g of toner)

M=Mass of material in the developer chamber (g)

$K_\sigma$=Exponential decay constant of σ in a non-trickle mode (1/kp)

$\sigma_0$=Time=0 σ level $\sigma_{min}$=Minimum σ level allowed in the system.

10. The replenisher according to claim 8, wherein the replenisher ratio is determined to be a greater ratio of the replenisher ratio determined as a function of the minimum $A_T$ level and the replenisher ratio determined as a function of the minimum conductivity level, which greater ratio is the replenisher ratio which contains the greater amount of carrier dispensed for a given amount of toner.

11. The replenisher according to claim 1, wherein the toner particles comprise a propoxylated bisphenol A fumarate resin and the toner resin has an overall gel content of from about 2 to about 9 weight percent by weight of the binder, wherein the colorant is carbon black, magnetite, or mixtures thereof, cyan, magenta, yellow, blue, green, red, orange, violet or brown, or mixtures thereof, and one or more external additives of one or more silicon dioxide powder, a metal oxide powder or a lubricating agent, and wherein the carrier particles comprise a steel core coated with polymethyl methacrylate at a coating weight of from 0.5 to 1.3% by weight of a total carrier particle weight.

12. The replenisher according to claim 11, wherein the metal oxide powder is titanium dioxide or aluminum oxide and the lubricating agent is zinc stearate.

13. The replenisher according to claim 1, wherein following triboelectric contact with the carrier particles, the toner particles have a charge per particle diameter (Q/D) of from −0.1 to −1.0 fC/μm with a variation during development of from 0 to 0.25 fC/μm and the distribution is substantially unimodal and possesses a peak width of less than 0.5 fC/μm, preferably less than 0.3 fC/μm and a triboelectric charge of from −25 to −70 μC/g with a variation during development of from 0 to 15μC/g.

14. A method of setting a replenisher ratio for a replenisher comprised of toner particles and carrier particles to be added to an image developing apparatus, the method comprising determining the replenisher ratio of the toner particles to the carrier particles in the replenisher as a function of at least one property of a developer for the apparatus and at least one operational property of the apparatus.

15. The method according to claim 14, wherein the determining determines the replenisher ratio as a function of the tribo stability of the developer in a non-replenishment mode of the apparatus.

16. The method according to claim 15, wherein the tribo stability of the developer is specified in terms of the replenisher rate (R) required in order to meet a minimum $A_T$ value of the apparatus according to the equation $$R_R=(YMK_A((A_1/(A_0-A_{min}))-1))^{-1}$$

where $R_R$=Replenisher ratio (g of toner/g of carrier in replenisher)

Y=Toner yield (kp/g of toner)

M=Mass of material in the developer chamber (g)

$K_A$=Exponential decay constant in a non-trickle mode (1/kp)

$A_1$=Range of $A_T$ decay from t=0 to t=infinity $A_0$=$A_T$ level at t=0.

$A_{min}$=Minimum $A_T$ value of the apparatus.

17. The method according to claim 16, wherein the minimum $A_T$ level of the apparatus ranges from 140 to 165 μC/g times % toner.

18. The method according to claim 16, wherein the exponential decay constant in the non-replenishment mode is derived from data on $A_T$ decay over time for different replenisher ratios.

19. The method according to claim 14, wherein the replenisher ratio ranges from 2:1 to 8:1.

20. The method according to claim 14, wherein the replenisher ratio is about 3:1.

21. The method according to claim 15, wherein the method further comprises determining a second replenisher ratio as a function of the conductivity of the developer in a non-replenishment mode of the apparatus.

22. The method according to claim 21, wherein the conductivity of the developer is specified in terms of the replenisher ratio required in order to meet a minimum σ value of the apparatus according to the equation $$R_R=(YMK_\sigma((\sigma_0/(\sigma_0-\sigma_{min}))-1))^{-1}$$

where $R_R$=Replenisher ratio (g of toner/g of carrier in replenisher)

Y=Toner yield (kp/g of toner)

M=Mass of material in the developer chamber (g)

$K_\sigma$=Exponential decay constant of σ in a non-trickle mode (1/kp)

$\sigma_0$=Time=0 σ level $\sigma_{min}$=Minimum σ level allowed in the system.

23. The method according to claim 21, wherein the determining further comprises determining the replenisher ratio to be a greater ratio of the replenisher ratio determined as a function of the minimum $A_T$ level and the replenisher ratio determined as a function of the minimum conductivity level, which greater ratio is the replenisher ratio which contains the greater amount of carrier dispensed for a given amount of toner.

24. An apparatus for developing an electrostatic latent image recorded on an image receiving member comprising:

a housing defining a chamber having a supply of developer comprised of toner particles and carrier particles therein, a donor member spaced from the image receiving member and adapted to transport toner particles of the developer from the chamber to a development zone adjacent the image receiving member, at least one wire positioned in the development zone between the image receiving member and the donor member, a voltage supply for electrically biasing the at least one wire during a developing operation with a current to detach toner particles from the donor member, forming a cloud of toner particles in the development zone, and developing the latent image with toner particles from the cloud, and at least one dispenser for dispensing replenisher comprised of toner particles and carrier particles into the chamber, wherein a replenisher ratio of the toner particles to the carrier particles in the replenisher is determined as a fimction of at least one property of the developer and at least one corresponding minimun operational property of the apparatus.

* * * * *